US012162647B2

(12) United States Patent
Dagher

(10) Patent No.: US 12,162,647 B2
(45) Date of Patent: Dec. 10, 2024

(54) REMOVABLE CONTAINER LINER

(71) Applicant: Huna, LLC, Boynton Beach, FL (US)

(72) Inventor: Andrew Dagher, Boynton Beach, FL (US)

( * ) Notice: Subject to any disclaimer, the term of this patent is extended or adjusted under 35 U.S.C. 154(b) by 0 days.

(21) Appl. No.: 18/432,705

(22) Filed: Feb. 5, 2024

(65) Prior Publication Data

US 2024/0262569 A1 Aug. 8, 2024

Related U.S. Application Data

(60) Provisional application No. 63/443,434, filed on Feb. 5, 2023.

(51) Int. Cl.
*B65D 25/16* (2006.01)
*B65D 25/18* (2006.01)
*B65D 65/38* (2006.01)

(52) U.S. Cl.
CPC ..... *B65D 25/16* (2013.01); *B65D 25/18* (2013.01); *B65D 65/38* (2013.01)

(58) Field of Classification Search
CPC ..... B65D 2590/046; B65D 2590/043; B65D 5/603; B65D 5/606; B65D 2590/04; B65D 25/16; B65D 25/18; B65D 65/38; B65D 2501/0009; B65D 90/041; B65D 90/043; B65D 90/045; B65D 90/046
See application file for complete search history.

(56) References Cited

U.S. PATENT DOCUMENTS 5,094,363 A * 3/1992 Monahan ..... A45F 3/20 222/523
5,137,162 A * 8/1992 Fritz ..... B65D 41/08 D9/519
5,579,935 A * 12/1996 Atkin ..... A61J 9/001 215/11.1
6,072,161 A * 6/2000 Stein ..... A47G 19/2288 219/386
7,134,577 B1 * 11/2006 Verma ..... B05B 11/0038 222/105

(Continued)

OTHER PUBLICATIONS https://saiehello.com/products/glowy-super-gel-luminizer?variant=32377073238076.

*Primary Examiner* — Kareen K Thomas
(74) *Attorney, Agent, or Firm* — Lowndes; Stephen C. Thomas; R. Richard Fredeking

(57) ABSTRACT

A removable liner disposed within the interior volume of a container, which liner has an interior volume for containing product such as food condiments or sauces, cleaning products, and any other product of a flowable nature and viscosity that allows for storage and extraction for later use by a user. When manipulation of the container, such as by squeezing the container or inverting the container such that its mouth portion or feature is oriented in a downward direction, or by gravity, or by both manipulating the container and by gravity, is no longer effective to remove product, the liner may be separated from the container, and remaining product may be removed from the liner through an openable closure in the liner. In some cases, substantially all of the remaining product may be removed from the container, reducing waste introduced into the environment, thus resulting in positive environmental impact.

23 Claims, 8 Drawing Sheets

(56) References Cited

U.S. PATENT DOCUMENTS

| | | | | |
|---|---|---|---|---|
| 7,404,534 | B1 * | 7/2008 | Hajianpour | A45F 5/02 248/248 |
| 2001/0019021 | A1 * | 9/2001 | Riviello, Jr. | B65D 51/24 206/0.5 |
| 2004/0094498 | A1 * | 5/2004 | Foley | A61J 9/001 215/11.1 |
| 2005/0172814 | A1 * | 8/2005 | Brunk | B01D 53/0415 96/108 |
| 2006/0021996 | A1 * | 2/2006 | Scott, III | B65D 81/3283 220/717 |
| 2006/0065132 | A1 * | 3/2006 | Jongen | B65D 83/0055 99/485 |
| 2008/0041807 | A1 * | 2/2008 | Tominaga | A61J 9/001 215/11.3 |
| 2011/0108516 | A1 * | 5/2011 | McFarland | B65D 23/02 215/382 |
| 2015/0014273 | A1 * | 1/2015 | Otero | B65D 23/001 215/316 |

* cited by examiner

REMOVABLE CONTAINER LINER

CROSS REFERENCE TO RELATED APPLICATIONS AND INCORPORATION BY REFERENCE

This non-provisional patent application is a non-provisional of, and claims benefit of priority to, U.S. Provisional Patent Application Ser. No. 63/443,434, entitled "REMOVEABLE CONTAINER LINER", filed in the United States Patent and Trademark Office (USPTO) on Feb. 5, 2023, the entire disclosure of which is incorporated herein by reference.

The following U.S. patents are incorporated by reference herein in their entirety: U.S. Pat. No. 2,810,944, entitled "Water and Gas-Tight Sliding Clasp Fastener", which issued from the United States Patent and Trademark Office (USPTO) on Oct. 29, 1957, which is incorporated herein by reference in its entirety; U.S. Pat. No. 5,138,750 to Gundlach et al. entitled "Zipper for Reclosure of Thermoplastic Bag", which issued from the USPTO on Aug. 18, 1992; U.S. Pat. No. 5,372,428 to Bruno entitled "Tamper Evident Bag With Perforations on the Sides and on the Flanges", which issued from the USPTO on Dec. 13, 1994, which is incorporated herein by reference in its entirety; U.S. Pat. No. 6,004,032 to Kapperman et al. entitled "Tamper-Evident Closure Arrangements and Methods", which issued from the USPTO on Dec. 21, 1999, which is incorporated herein by reference in its entirety; and U.S. Pat. No. 7,029,178 to Gzybowski, entitled "Zip-Lock Closure", which issued from the United States Patent and Trademark Office on Apr. 18, 2006, which is also incorporated herein by reference in its entirety.

STATEMENT REGARDING FEDERALLY SPONSORED RESEARCH OR DEVELOPMENT

Not applicable.

INCORPORATION-BY-REFERENCE OF MATERIAL SUBMITTED ON A COMPACT DISK

Not applicable.

BACKGROUND OF THE INVENTION

1. Field of the Invention

The field of the invention relates generally to systems and methods for providing a container for storing, transporting and using products of a flowable nature such as food condiments, sauces, cleaning products, shampoo, liquid soaps, powders and other products of a flowable nature. More specifically the field of the invention relates to a removable container liner that is operable to assist a user in removing the last remaining contents from a container ("remaining product") such that a user is able to retrieve and use remaining product that would otherwise not be available to the user without the apparatus and method of the invention, and would thus otherwise be discarded into the natural environment, potentially causing damage to the environment and related ecosystem(s).

2. Background Art

It is a well-known problem with containers of the prior art, such as, for example, liquid soap containers, hair shampoo and conditioner containers, food condiment containers, and other containers, that, after a period of use, the last remaining contents of such containers may not be accessible by a user, and thus is wasted product that ends up being discarded and ultimately discharged into the natural environment and related ecosystem(s).

For example, as regards liquid soap, hair shampoo or conditioner containers, food condiment containers, or the like, a user may be able, by using gravity, and cases in which the container comprises a flexible material, by squeezing the container, to extract between seventy and ninety percent of the product packaged in the container, leaving ten to thirty percent of the product still in the container and inaccessible by the user ("remaining product"). Most often this remaining product is discarded along with the used container, leading to ten to thirty percent wasted product and having a negative impact on the natural environment resulting from the discarding of the wasted product into the environment. Further, this waste causes significantly more product to be produced than is being consumed, wasting natural resources and artificially inflating product costs of manufacturer, which costs are generally flowed down to the consumer.

Various methods have been conceived for removing the remaining product from a used container. For example, users in some cases attempt to insert a utensil such as, for example, a spoon or butter knife, into a mouth of the container in order to scrape some of the remaining product out through the mouth of the container. In other cases, users invert the container, i.e. with the mouth opening of the bottle pointing in a downward direction, while shaking the container vigorously in an up-and-down motion. However, neither of these methods work well, especially in cases in which the mouth of the container is too narrow to allow a significant portion of the remaining product to be removed using a utensil, and when the remaining product is too viscous to be extracted by the gravity-assist inverted bottle shaking method.

Certain container packaging advances have been made over the years in the art of container design. One such advances has been the use of wide-mouth containers, which may even be stored in an inverted, i.e. upside down, position. While such advances have made minor improvements in the retrieval of remaining product, there still remains the problem that there is remaining product in the containers of the present art that cannot be accessed or retrieved by a user, and thus the remaining product, which can be up to ten or even thirty percent of the product originally present in the container, must be discarded, representing environmental disposal concerns, as well as waste of otherwise usable product. Further, many business entities are under pressure to manage their business operations with an increased emphasis on Environmental, Social, and Governance (ESG) issues. This pressure, which may for example, be applied by government regulation, investors, lending institutions, strategic partners and other entities, may require that product waste be considered and minimized in the operation of the business. The present invention provides a novel, cost-effective system, apparatus and method for minimizing waste and is therefore an enabling technology for meeting ESG requirements.

What is needed in the art, therefore, is an apparatus and/or method adapted to allow a user to retrieve and use remaining product from a container.

BRIEF SUMMARY OF THE INVENTION

The present invention comprises an apparatus and method that have one or more of the following features and/or steps which alone or in any combination may comprise patentable subject matter.

It is an object of an embodiment of the invention to provide a removable liner, or bladder, that is able to be disposed within the interior volume of a container, into which liner product is placed for later dispensing and use by a user. The product may be any liquid, powder or other material, of any viscosity, that is able to be caused to exit the container by manipulation of the container, such as by squeezing the container or inverting the container such that its mouth portion or feature is oriented in a downward direction, or by gravity, or by both manipulating the container and by gravity. The removable liner may be removably attached to the container. The removable liner may be, in embodiments, removable by the user by detaching it from the container and pulling the removable liner through the container mouth, and out from the interior volume of the bottle, where the user is able to manipulate the removable liner containing the last remaining product, so as to remove the last remaining product from the interior volume of the removable liner, thus enabling the user to access and use the last remaining product. In embodiments, the last remaining product may comprise between ten percent (10%) and thirty percent (30%) of the amount of product originally stored in container.

It is a further object of the invention that the removable liner be attached, or, in embodiments, removably attached, to a mouth of the container. In embodiments this attachment or removable attachment to the container may be located at or near the container mouth.

It is a further objection of embodiments of the invention to provide features and/or elements of the invention, such as, but not limited to, the liner release tabs described herein, that, when manipulated by a user, operate as a removable attachment, allowing the user to manipulate the liner release tabs causing them to detach, or break away, from a surface or other portion of the container, for example the container mouth wall, thus enabling the user to remove the removable liner from the container, the removable liner containing remaining product within its interior volume. In embodiments, the liner release tabs may be removably attached to a portion of the container, such as the container mouth wall, by a detachable break-away attachment.

It is a further objection of embodiments of the invention to provide features and/or elements of the invention, such as, but not limited to the openable closure described herein, such that the removable container liner may be openable, and, in embodiments, resealable by the user's manipulation of the closure. The use of the openable closure may assist the user in removing a greater portion of the remaining product from the interior volume of the removable liner than would be possible if the removable liner were unable to be opened. The openable closure may be, but is not necessarily, re-closable and re-sealable by manipulation of the closure by, for example, by the use of the user's fingers or by use of a slider closure feature that forces two opposing faces along the length of the openable closure to be forced together such that they are received by one another, forming a sealed closing of the openable closure. The openable closure may be a slide or non-slide type closure.

In embodiments, the invention comprises a removable liner for a container, the container having a mouth and a container interior volume in which the removable liner is disposed, and the container mouth having an opening, the invention comprising: a liner, which may be a removable liner, having an interior volume, wherein the removable liner encloses the removable liner interior volume completely except for a removable liner mouth portion; at least one liner release tab that is attached to the removable liner mouth portion, the at least one liner release tab also forming a break-away part of the container mouth; wherein, when the at least one liner release tab is depressed towards the container mouth opening, it breaks away from the container mouth, allowing the removable liner to be removed from the container interior volume through said container mouth.

In embodiments, the at least one removable liner release tab may be further defined as two liner release tabs, and the two liner release tabs may be located so as to oppose one another on said liner and/or container mouth portion.

In embodiments, the at least one liner release tab may be further defined as more than two liner release tabs.

In embodiments liner release tab break-away portion may be further defined as a liner release tab area at least partially outlined by a void, or series of voids, that extend partially through a wall of the container mouth, the voids being of sufficient depth to allow the liner release tab to be broken away from the container mouth by a user's finger pressure applied to the liner release tab in the direction of the container mouth opening, allowing the removable liner to be separated from the container by pulling it completely through the container mouth opening such that the removable liner is removed from the container interior volume.

In embodiments, the removable liner may comprise a flexible sealing opening disposed in the mouth opening of the removable liner. The flexible sealing opening may comprise one or more slits having a first side and second side that come together in physical contact to prevent product from exiting the interior volume of the removable liner, but, when a pressing or squeezing force is applied to the one more slits, the first and second side of each split are caused to separate by the application of the pressing or squeezing force to the slit, causing the slit to open, and allowing product to be squeezed out from the interior volume of the removable liner.

In embodiments, the removable liner may comprise one or more plastic materials.

In embodiments, at least a portion of the removable liner material may be further defined as comprising a flexible material, such as, for example, a flexible plastic material.

In embodiments, the removable liner may further comprise an openable closure, that, when in an open state, allows a user access to the interior volume of the removable liner, enabling removal of remaining product from the interior volume of the removable liner.

In embodiments, the openable closure may be oriented in a lengthwise direction relative to the exterior shape of the removable liner.

In embodiments, the openable closure may be resealable, or re-closable.

In embodiments, the openable closure may be further defined as a slider closure having a slider member for opening said openable closure. In embodiments, the slider feature may also be used to re-close or re-seal the openable closure.

In embodiments, the removable liner may comprise food grade plastic material.

In embodiments, the removable liner may be microwavable such that food products disposed in the interior volume of the removable liner may be heated by microwave energy and remain safe for human consumption.

In embodiments, the features and elements of the invention described herein and depicted in the figures, and all legal equivalents thereof, may be present in any number or combination. Further, in embodiments, the invention may comprise a subset of the defined features and elements, in any combination. While a particular embodiment may comprise each of the features described and shown, it is not necessary that any other embodiment of the invention comprise each of the features described and shown.

BRIEF DESCRIPTION OF THE DRAWINGS

The accompanying drawings, which are incorporated into and form a part of the specification, illustrate one or more embodiments of the present invention and, together with the description, serve to explain the principles of the invention. The drawings are only for the purpose of illustrating exemplary embodiments of the invention and are not to be construed as limiting the invention. In the drawings, like callouts refer to like features.

In the drawings.

DETAILED DESCRIPTION OF THE INVENTION

Figure 1:
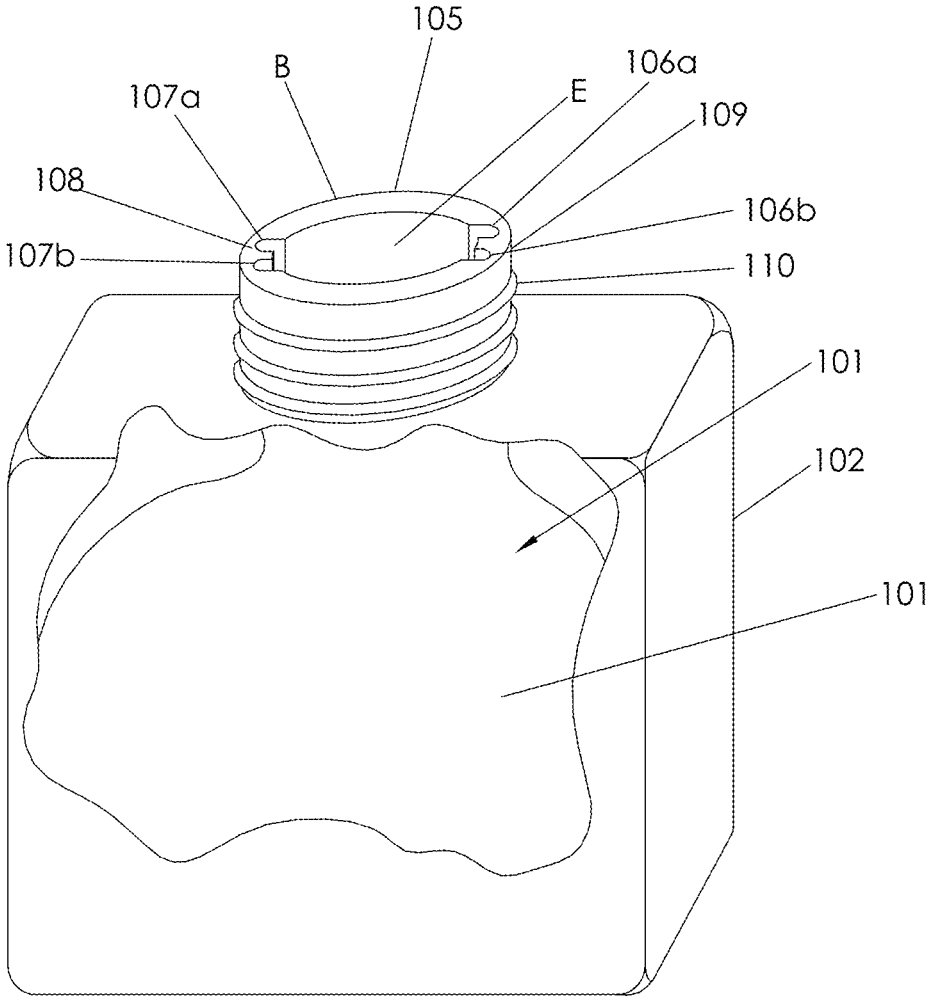
FIG. 1 depicts a perspective view of a container in which a portion of the removable liner for containing product 101 of the invention is viewable through a cutout portion of a container wall. The cutout view is provided for illustrative purposes.

The following documentation provides a detailed description of the invention.

Although a detailed description as provided in this application contains many specifics for the purposes of illustration, anyone of ordinary skill in the art will appreciate that many variations and alterations to the following details are within the scope of the invention. Accordingly, the following preferred embodiments of the invention are set forth without any loss of generality to, and without imposing limitations upon, the claimed invention. Thus, the scope of the invention should be determined by the appended claims and their legal equivalents, and not merely by the preferred examples or embodiments given.

As used herein, "resealable closure", "openable closure" and "closure" mean any openable closure, that may be, in embodiments, also be re-closable or re-sealable, that is, able to be opened and closed using either a sliding member that is slidably coupled to each of the opposite sides of an opening in a bag, bladder or liner, or, in embodiments, is able to be closed without the use of a sliding member by use of a user's fingers. Examples of such closures may be known as "Zip-Loc" or "Zip-Lock" closures. In the slider embodiments the slider may be configured so that as it is motivated in a first direction, it couples the cooperating interlocking or coupling structure of the two sides of the opening together, resulting in an openable closure closed state. In embodiments, the two coupled sides of the opening then form a liquid-tight and/or gas-tight seal along the length of the opening. As the slider is motivated in a second direct direction, opposite to the first direction, the slider uncouples the cooperating interlocking or coupling structures of the two sides of the opening, resulting in a closure open state that allows the interior volume of the removable liner to be accessed by the user. In non-slider embodiments, a user may use their thumb and/or fingers to slidably engage the cooperating interlocking or coupling structure of the two sides of the opening together, effectively re-closing or re-sealing the openable closure. To provide the opening and closing function, the opposite side edges of the openable closure are provided with cooperating structural features that can be coupled together, or interlocked, to form a sealed closure. There are different types of closure structures, including those that include slider devices that couple and uncouple the closure structures, those that do not include slider devices that couple and uncouple the closure structures, those that are resealable and those that are not resealable. Exemplary embodiments of openable closures that may comprise sliding members, or may not comprise sliding members, are found in the following U.S. patents, each of which is incorporated by reference herein in its entirety. U.S. Pat. No. 5,138,750 to Gundlach et al. exemplifies a closure that includes a closure structure that is operated by pressing the opposite sides of the mouth of the bag together. Using this type of bag-type closure, the user typically squeezes the opposite sides of the mouth together between his or her thumb and index finger and slides his or her finger and thumb along the mouth of the bag so that the cooperating interlocking or coupling structures are engaged together. An alternative approach that some people take is to squeeze incremental portions of the opposite sides of the mouth of the bag together along the length there. Once closed, the mouth of the bag can be opened by gripping and pulling the opposite sides of the mouth of the bag apart. Such a bag is resealable. U.S. Pat. No. 2,810,944 to Sander exemplifies a bag-type closure that includes a closure mechanism having a slider. The slider can be thought of as providing a function similar to the user's thumb and index finger as discussed above in U.S. Pat. No. 5,138,750. That is, the slider, which is slidably coupled to each of the opposite sides of the mouth of the bag, is configured so that as it is motivated in one direction, it couples the cooperating interlocking or coupling structures of the mouth of the bag together. In contrast, as the slider is motivated in the opposite direction, it uncouples the cooperating interlocking or coupling structures of the mouth of the bag. U.S. Pat. No. 5,372,428 to Bruno et al. and U.S. Pat. No. 6,004,032 to Kapperman et al. exemplify non-resealable bag-type closures which are configured to be permanently sealed after various items and substances are placed therein. The mouths of non-resealable bag-type closures include cooperating interlocking or coupling structures, which when engaged together, resist being opened. In some cases, it is known to provide bags having non-resealable bag-type closures with secondary means for gaining access to the contents thereof. For example, such bags can include tearable, e.g. perforated, frangible, etc. portions that can be torn apart to gain access to the contents of the bags. The present invention may comprise any of the above closures, or any other form of closure, including but not limited to closures and/or resealable closures that provide one-way zip-locking closures for bag-type, or bladder, containers.

As used herein, "container" means any container of any volume, shape or size, which may be, for example a bottle or any other type of container, that is intended to contain product in an interior volume of the container. The container may be, but is not necessarily, adapted to receive a screw-on top, which may be a simple cap or dispensing cap, and a threaded engagement. The container may comprise any materials that are typically used and are known in the art to be used in container manufacturer, but typically, the container material may be a type of plastic material. Typical containers use may include, for example and not by way of limitation, the containment of food products, such as, for example, sauces, condiments and any other food product having a flowable nature and viscosity amenable to allowing such product to be stored, transported and later removed from the container for use by a user; cleaning products; household products for use in crafts or hobbies, such as for example glue or chemical adhesives; or any other products that are of such a flowable nature and viscosity that they may be stored in the interior volume of a plastic container, which may be flexible plastic, so that the product may be later removed by a user. In many cases, the user may be a consumer, but this is not a limiting aspect of the invention. The user may be any person or entity, and may for example, be an industrial or other user.

As used herein, "product" means any material intended to be stored in a container, which product may or may not be liquid.

As used herein, "liner" and "bag" and "bladder" include within their meanings liners or bladders that fit within, and may be attached or removably attached to, a container. The purpose of the liner is to contain product within an interior volume of the liner or bladder, and when the liner or bladder is disposed inside a container, it can be said that the product stored in the interior volume of the liner is effectively stored in the container. For example and not by way of limitation, in embodiments, a removable liner of the invention 001 may comprise a removable liner portion for containing product (also referred to as a "bladder" or "bladder portion" or "bag") 101, and also a mouth or other portion.

As used herein, "food grade plastic" includes within its meaning any plastic material that has been determined to be safe for human consumption, or has been deemed to be safe for direct contact with food expected to be consumed by humans, by an authoritative body such as, for example, the United Stated Food and Drug Administration (FDA). A plastic material may be determined to be "food grade plastic" for specific applications, and may be determined not to be a "food grade plastic" in other applications. For example, in some cases a specific plastic material may be determined to be a "food grade plastic" in applications in which the temperature of the plastic material will not exceed an upper temperature limit. As a non-liming example, a plastic material may be determined to be a "food grade plastic" for applications in which the plastic material is not exposed to temperatures exceeding an upper temperature limit of 150° F. In this example, the plastic material would not be considered to be a "food grade plastic" in cases in which the plastic material is exposed to a temperature exceeding 150° F. And so on. Non-limiting examples of food grade plastics include, but are not limited to, polyethylene terephthalate (PET), high-density polyethylene (HDPE), polyvinyl chloride (PVC), low-density polyethylene (LDPE), polypropylene (PP), polystyrene (PS) and polycarbonate, alone or in any combination.

As used herein, "microwavable" plastic materials are plastic materials that have been determined to be safe for human consumption, or have been deemed to be safe for direct contact with food expected to consumed by humans, when exposed to microwave cooking radiation, by an authoritative body such as, for example, the United Stated Food and Drug Administration (FDA). Examples of microwavable plastic materials that have been deemed to be safe for human consumption and/or to be safe for direct contact with food expected to be consumed by humans after exposure to microwave cooking radiation are HDPE and PP. Examples of non-microwavable plastic materials that have been deemed not to be safe for human consumption and/or not to be safe for direct contact with food expected to be consumed by humans after exposure to microwave cooking radiation are PS and PET.

Referring now to FIG. 1, a perspective view of a container 102 having an exemplary embodiment of a removable liner of the invention 001 disposed therein, in which the removable liner 001 is viewable through a cutout portion of a container 102 wall, is depicted. The cutout is provided in the figure merely for illustrative purposes and is not to be construed as a feature of the container. Container 102 may have a mouth portion 105 that has a mouth opening E through which product passes from the interior volume of the removable liner 001 to be used by the user. Container mouth portion 105 may have an exterior dimension B. Voids 106*a*, 106*b*, 107*a*, and 107*b* may extend into the material forming the wall of mouth 105 of container 102 to a depth F (see FIG. 2), creating releasable liner tabs 108 and 109. The removable liner of the invention 001 may be disposed inside the interior volume of container 102 such that product intended to be stored inside the interior volume of container 102 is disposed within an interior volume of removable liner 001. Removable liner 001 may be attached to liner release tabs 109 and 108 by, for example, any means known in the art such as, but not limited to chemical bonding, ultrasonic welding, or other known means for attaching materials together. Container 102 mouth portion 105 may have an exterior diameter B and male threads 110 for receiving a container cap in a threading engagement. The container cap is not shown in the figure. Container 102 may be of any size or shape; the size and shape depicted in the figure is merely exemplary. The bladder portion of the removable liner, 101, i.e. the portion of the liner for containing product, is shown for reference.

Figure 2:
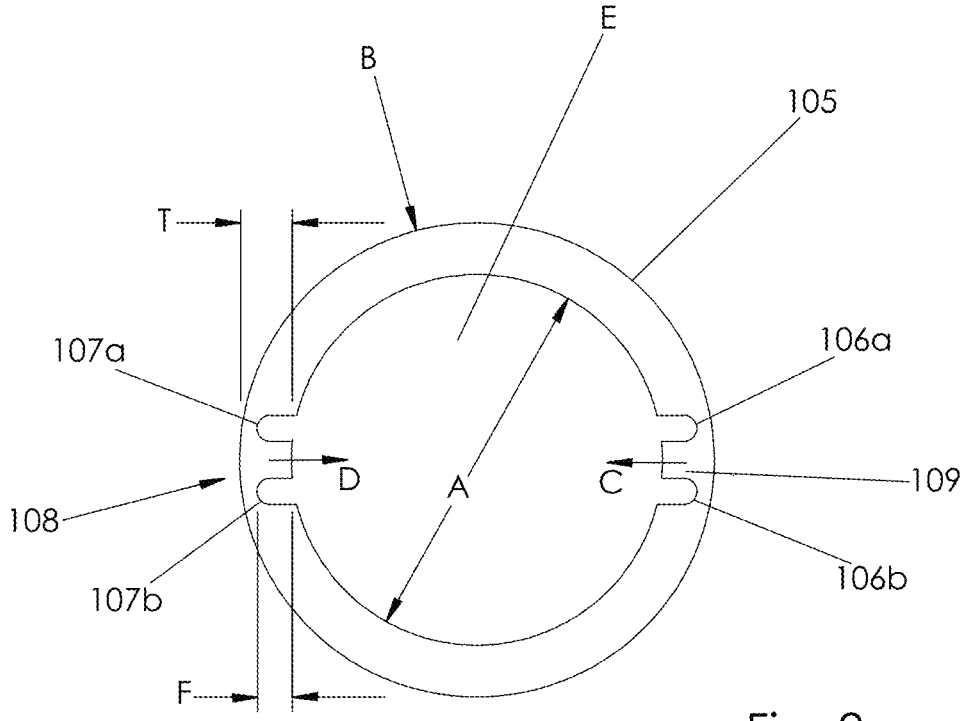
FIG. 2 depicts a top view of the mouth of an embodiment of the invention, showing the liner release tabs in a nominal, i.e. undetached, condition.
Figure 3:
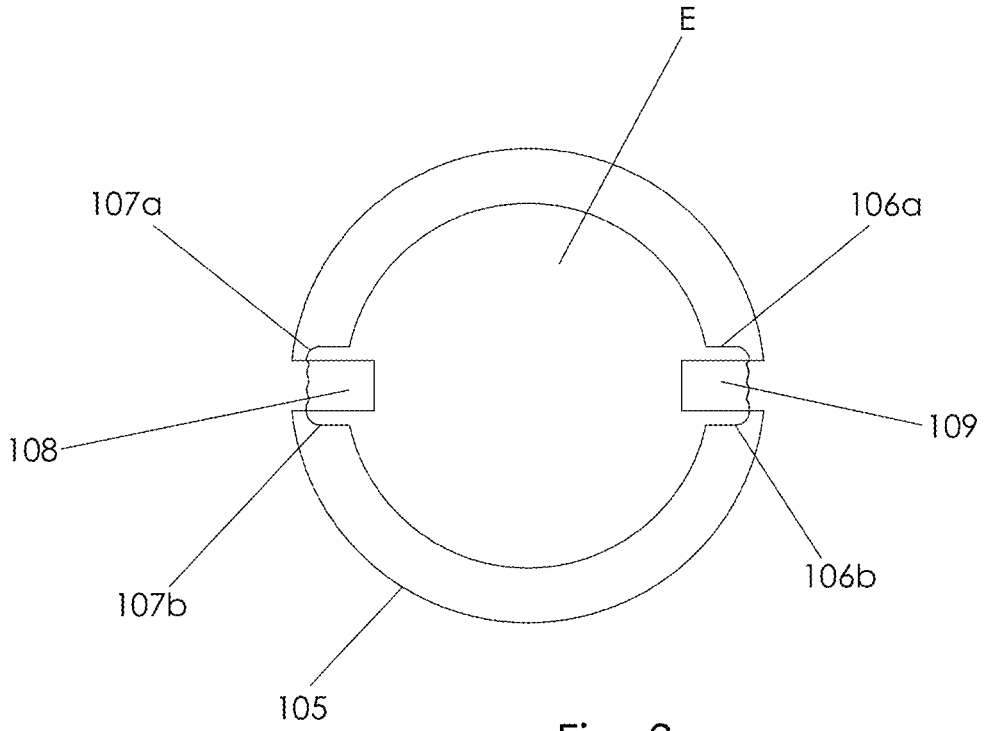
FIG. 3 depicts a top view of the mouth of an embodiment of the invention, showing the liner release tabs in a depressed, i.e. detached, condition.
Figure 4:
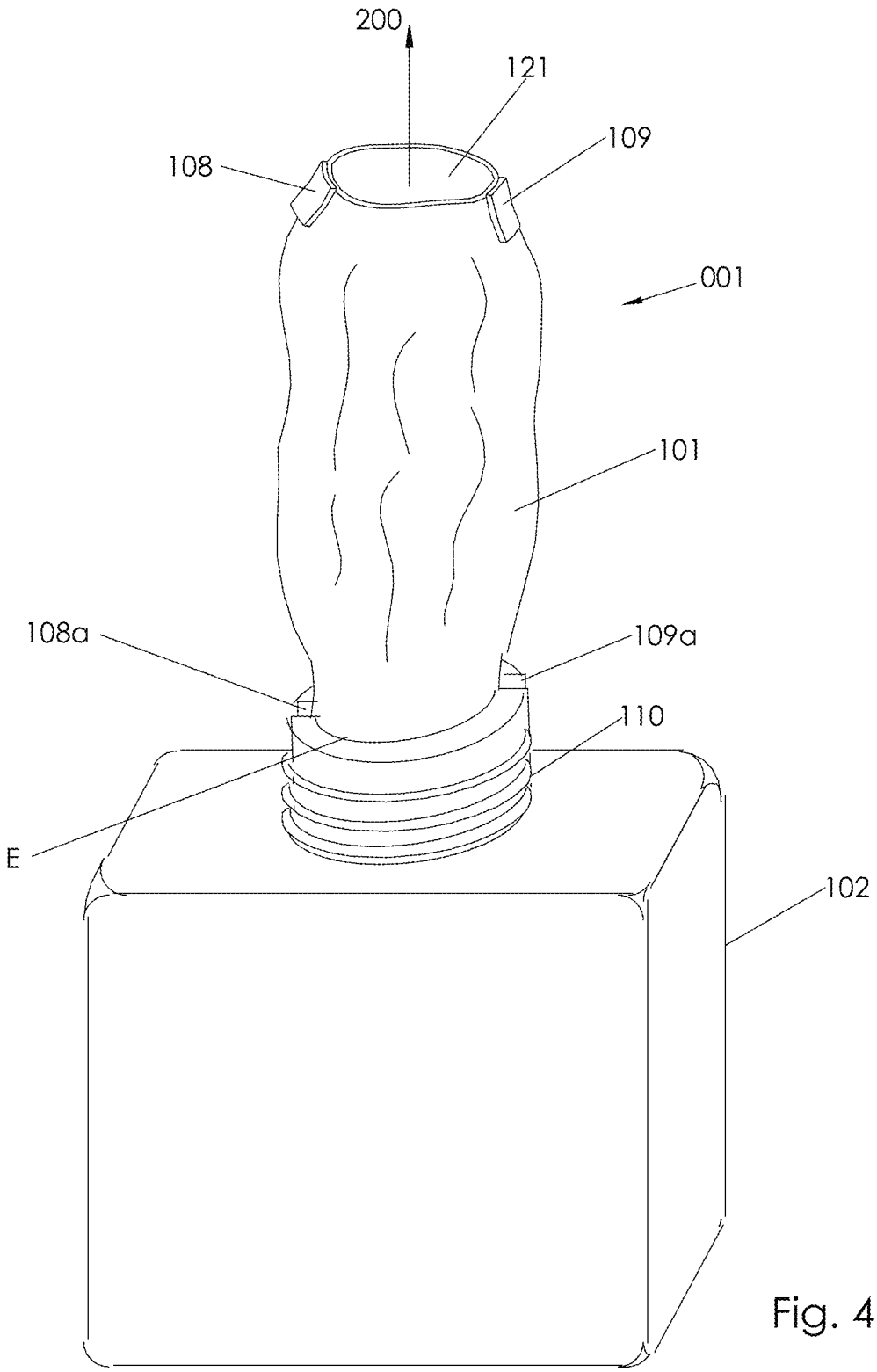
FIG. 4 depicts a perspective view of an embodiment of the invention, showing the removable liner in the process of being removed from the container in the direction of arrow 200.

Referring now to FIGS. 2 and 3, a top view of the mouth of an embodiment of a container of the invention, showing the liner release tabs 108 and 109 in a nominal, i.e. undetached, condition and depicting voids 106*a*, 106*b*, 107*a*, and 107*b* that are operable to allow a user to detach the liner release tabs by pressing them away from the material forming the mouth of the container, is depicted. Voids 106*a*, 106*b*, 107*a*, and 107*b* extend into the material forming the wall of mouth 105 of container 102 to a depth F, such that a weakness is formed in the wall of the mouth 105 of container 102. The weakness thus formed by voids 106*a*, 106*b*, 107*a*, and 107*b* in the wall of the mouth 105 of container 102 is great enough that liner release tabs 108 and 109 may be broken away from the material forming the wall of container mouth 105, for example, by forces applied by the fingers of a user. The material forming container 102 and the wall of mouth 105 of container 102 (container 102 is not depicted in FIGS. 2 and 3, but is depicted in FIG. 1) may be any material known in the packaging art, but is typically a plastic material. When a force C is applied to liner release tab 109, and a force D is applied to liner release tab 108, liner release tabs 108 and 109 may break away completely from the adjacent material of mouth 105 as depicted in FIG. 3. The shape, depth F, number of voids 106*a*, 106*b*, 107*a*, and 107*b* and configuration of voids 106*a*, 106*b*, 107*a*, and 107*b* may be of any shape, number, depth or dimension necessary to enable tabs 108 and 109 to be broken away from the adjacent material of mouth 105 at voids 106*a*, 106*b*, 107*a*, and 107*b* as depicted in FIG. 3 by any force that may be applied by a user's fingers, for example, and not by way of limitation, in a range 0.2 pounds to 2.0 pounds of force, or greater. When liner release tabs 108 and 109 are broken away from the wall of mouth 105 of container 102, the removable liner 001 may be removed from container 102 by pulling the removable liner 001 through the mouth opening E of container 102 as shown in FIG. 4. The container mouth 105 wall thickness T may be defined as being half the difference between the outer container mouth diameter B and the container mouth opening diameter A.

Referring now to FIG. 4, a perspective view of an embodiment of the invention, showing the removable liner 001 in the process of being removed from the container 102 in the direction of arrow 200, is depicted. In FIG. 4, liner release tabs 108 and 109, which are attached to the mouth 121 of removable liner 001, have been broken away from the container mouth by the application of finger pressure on each of the liner release tabs 108 and 109, with the finger pressure force being applied in a direction towards the opening of the container mouth opening E with sufficient force to break liner release tabs 108 and 109 away from the container mouth wall. When liner release tabs 108 and 109 are broken away from the container mouth wall, the removable liner 001 is able to be pulled through the container mouth opening E in the direction of arrow 200, allowing the removable liner 001 to be completely removed from container 102. When liner release tabs 108 and 109 have been broken away from the container mouth wall, voids are created in the container mouth wall where the liner release tabs 108 and 109 were previously located. These voids created in the container mouth wall are depicted in FIG. 4 as voids 108*a* and 109*a*, respectively. Container mouth cap-retaining male threads 110 are depicted in FIG. 4 for reference. Removable liner 001 may comprise bladder portion, or portion for containing product, 101.

Figure 5:
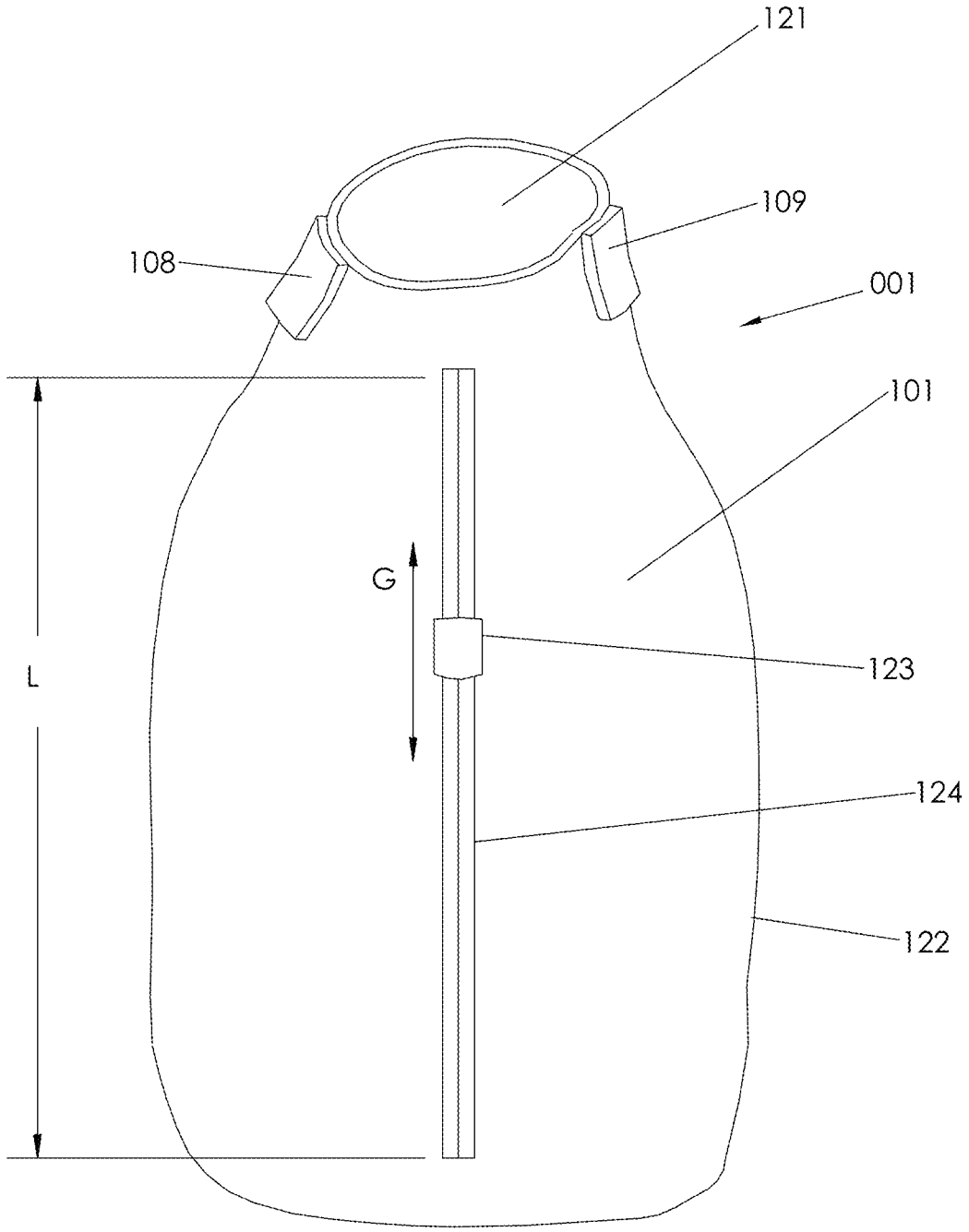
FIG. 5 depicts a front view of an embodiment of the removable liner of the invention.
Figure 6:
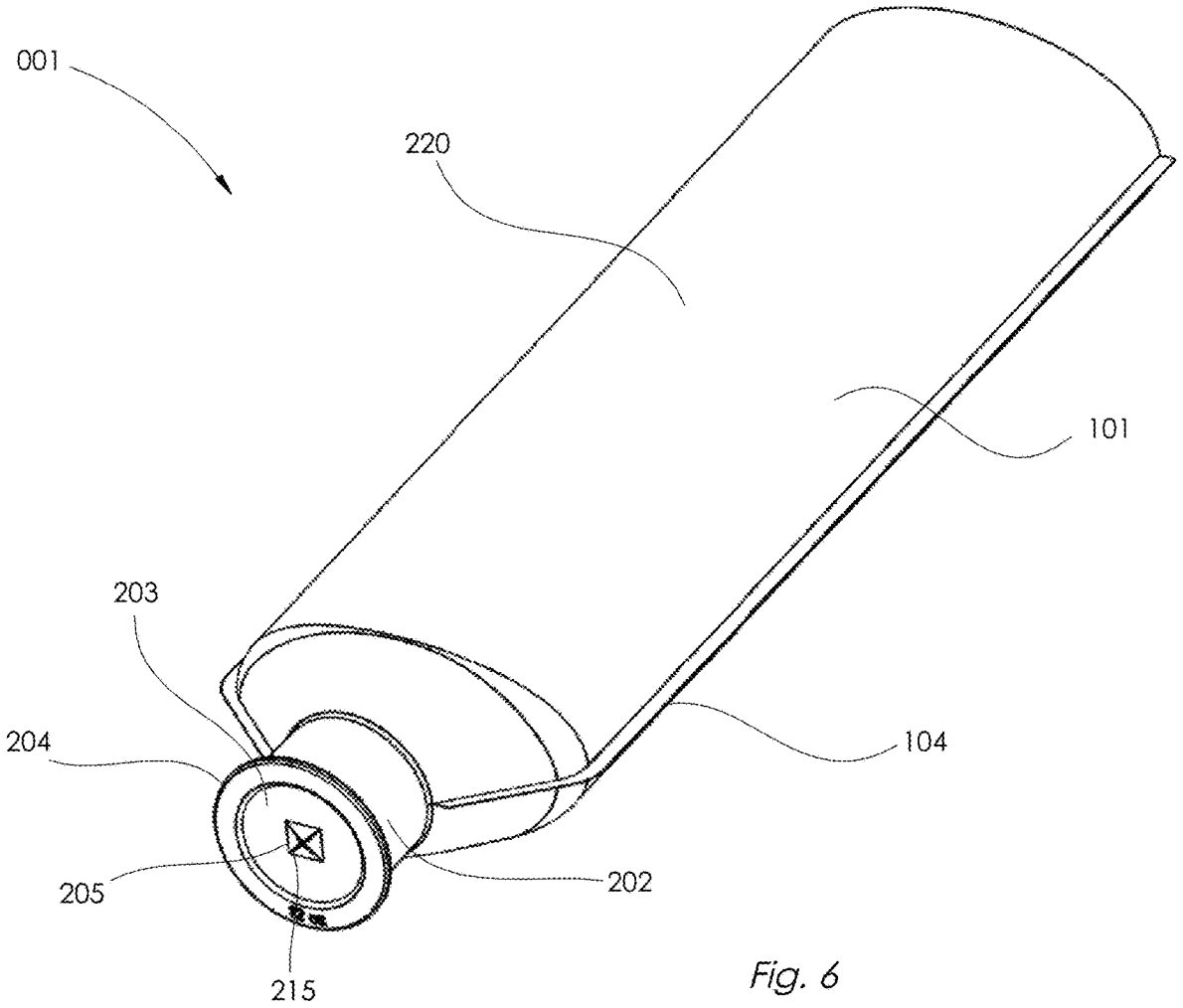
FIG. 6 depicts a perspective view of an embodiment of the removable liner of the invention, in which the invention comprises a flexible sealing opening in the mouth portion of the removable liner.
Figure 7:
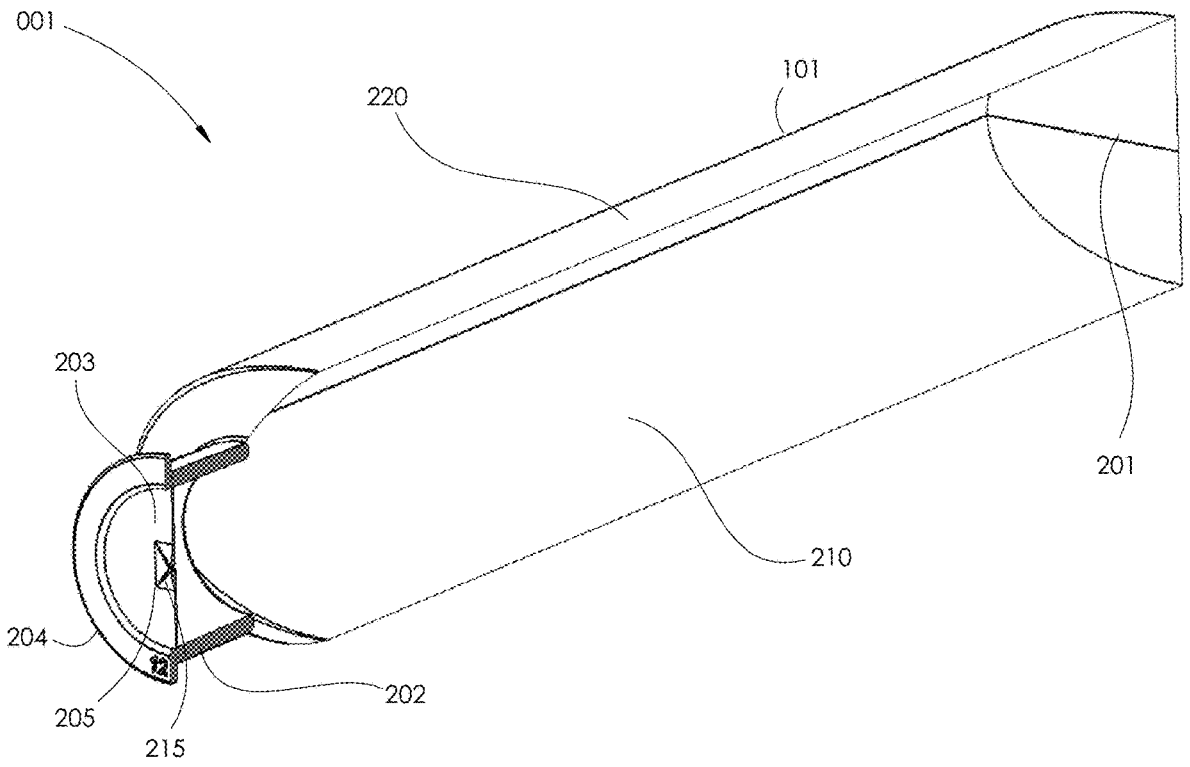
FIG. 7 depicts a perspective cutaway view of an embodiment of the removable liner of the invention.

Referring now to FIG. 5, a view of an embodiment of the removable liner 001 of the invention is depicted. Depicted for reference are removable liner mouth 121, liner release tab 108, and liner release tab 109. As mentioned above, liner release tabs 108 and 109, which are attached to removable liner 001, have been broken away from the container mouth wall, allowing liner 101 to be removed from container 102. An openable closure 124 is depicted running lengthwise along a surface of removable liner bladder portion (i.e. the portion for containing product) 101. Openable closure 124 may be of the slider or the non-slider type of closure. In embodiments, a closure slider element 123 may be used to open openable closure 124 and, in embodiments, to re-seal openable closure 124, but it is to be understood that this type of closure, in which a slider is used to open and to possibly reseal closure 124, is an optional embodiment of the openable closure. The scope of the invention includes any form of openable closure 124 that functions as described herein. It is not necessary that the openable closure of 124 be a slider type openable closure. Closure 124 may run for a length L along an exterior surface 122 of bladder portion, or portion for containing product, 101. In embodiments, bladder portion, or portion for containing product 101 may have an exterior surface 122 that is interrupted only by openable closure 124, and a mouth opening. Openable closure 124, when in a closed state, provides a sealed closure of an opening in a surface 122 of removable liner 101. When openable closure 124 has been opened, such as when slider 123 has been operated in the direction of arrow G to open closure 124 or when a user's hand or fingers have pulled opposing sides of opening 124 away from one another, the interior volume of removable liner 001 is able to be accessed by the user for the removal of remaining product. Opening openable closure 124 allows a user to easily access remaining product that is still retained in the interior volume of removable liner 001 after it is no longer possible to remove such product from the interior volume of removable liner 001 when removable liner bladder portion 101 is still disposed within container 102 interior volume. The purpose of removable liner 001 is that it is removable from container 102, which enables removal of remaining product from the interior volume of removable liner 001. In embodiments of the invention that comprise openable closure 124, the removable of product from the interior volume of removable liner 001 is aided by the opening of openable closure 124 such that remaining product may be accessed by a user and removed from the interior volume of the bladder portion 101 of removable liner 001. These features enable the user to access and use remaining product that was previously inaccessible when removable liner 101 was still within the interior volume of container 102. In embodiments, openable closure of 124 may be resealable or re-closable by either operating optional slider 123 in the direction of arrow G, or by a user using their fingers to press the opposing sides of opening 124 into a closed and sealed state, or by any other means known in the art. Thus, it may be possible for a user to re-close, or to re-seal, openable closure 124, placing openable closure 124 in a closed state allowing any remaining product to be stored for use at a later time. When openable closure 124 is in a closed state, or in a sealed state, no product is able to pass through or around openable closure 124. Thus, when removable liner 001 is contained within the interior volume of container 102, as in normal use of container 102, no product is able to exit removable liner 001 to occupy the space between the exterior surface of removable liner 101 and the interior surfaces of container 102.

A container 102 may be produced having a removable liner 001 of the invention, wherein the removable liner 001 is able to be filled with product to be dispensed by a user using the container 102. The product may be any product that is normally contained within a container for sale to, or use by, a user. Non-limiting examples of product include, but are not limited to, food products such as condiments, sauces, glazes and other similarly structured materials; and cleaning products such as liquid soaps, shampoos, body washes, and other similar cleaning products. These are but a few exemplary products of possible product that may be contained by the container and removable liner. Embodiments of removable liner of the invention may be intended for use with any product that is of such viscosity that the product may not be fully removable from the removable liner 101 while the removable liner remains in the container 102, and the container 102 is used in the conventional manner such that a user is unable to remove all of the product from the container. In such instances, the user may detach the removable liner 001 from the container 102. In embodiments, this may be accomplished by detaching liner release tabs 108 and 109 from the mouth portion of the container by depressing the liner release tabs towards the container mouth opening E until they break away from the material comprising the mouth wall of the container 102 by virtue of voids 106*a*, 106*b*, 107*a*, and 107*b* as depicted in FIGS. 2 and 3. When the liner release tabs 108 and 109 have broken away from the material comprising the mouth wall portion of the container as depicted in FIG. 3, the removable liner 101 is able to be removed from container 102 by pulling it through container mouth opening E, and away from the mouth of the container, causing the removable liner 101 to be removed from container 102 by pulling it through the mouth opening E of container 102. In other embodiments, this may be accomplished by pulling the removable away from container 102 such that the bladder portion 101 is pulled through the container mouth opening such that the bladder portion 101 is removed from the interior volume of container 102.

Once the removable liner of the invention 101 has been separated from and removed from the container 102, a user may proceed to extract the remaining product from the interior volume of the removable liner bladder portion 101. A user may do this by simply squeezing or rolling up the flexible material comprising the removable liner bladder portion 101 from the bottom of the liner bladder portion 101 towards the mouth of the liner 121, causing remaining product to be squeezed out through the mouth 121 of the removable liner 001.

Still further, a user may open the openable closure 124, which may be a re-sealable or re-closable opening, that may be closed using a closure or a resealable closure as defined in this description, or as may otherwise be known in the art. By opening the openable closure 124 in the removable liner 101, the interior volume of the removable liner 101 may be accessed easily by the user through the open closure, since it is in an open state. In this case, a user may invert the removable liner through the opening such that the interior volume is inverted and forms an exterior surface, allowing all the remaining product that was formerly captured in the interior volume of the liner to be accessed by the user. The openable closure 124 is an optional feature that may but is not necessarily, present in any embodiment of the invention.

Figure 8:
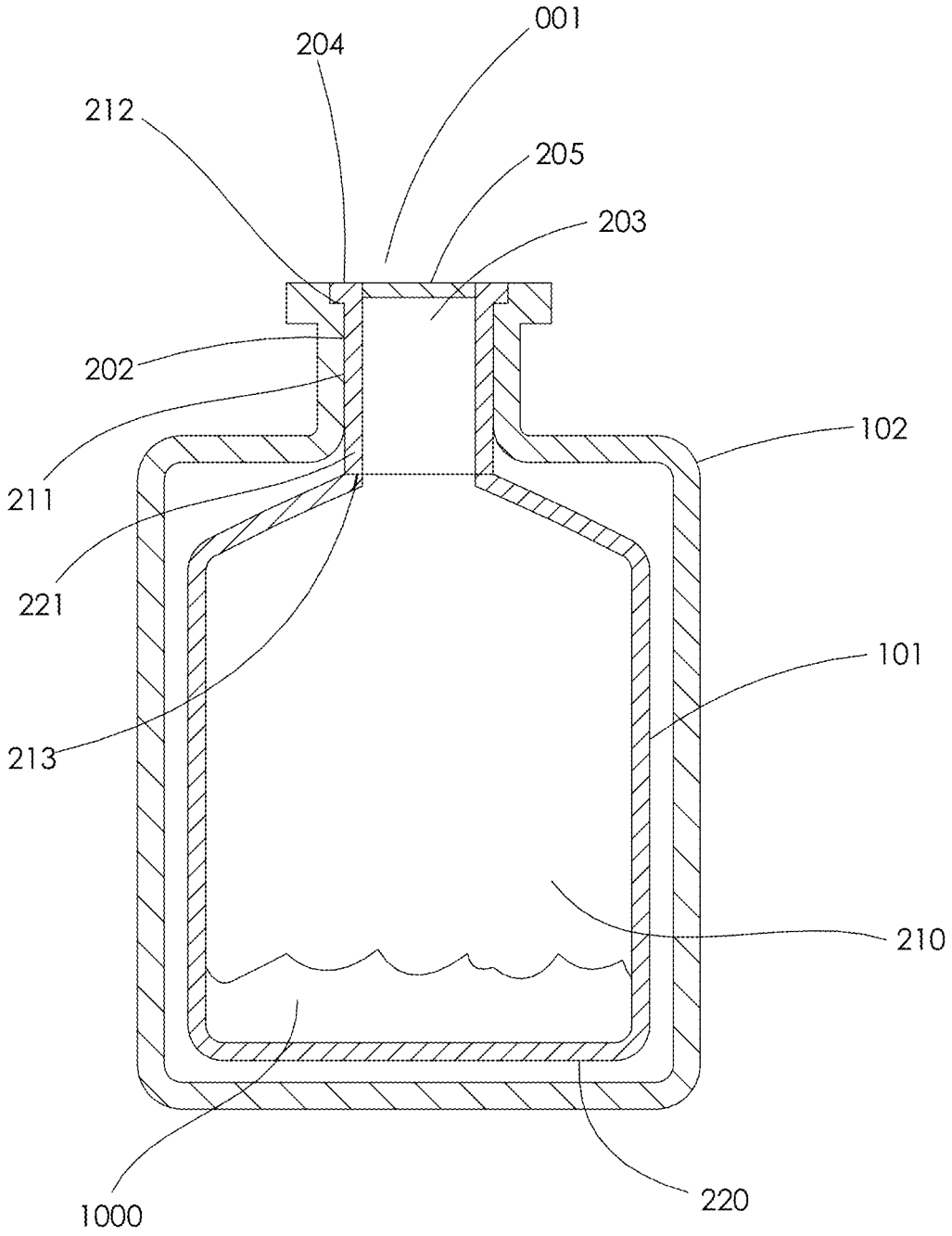
FIG. 8 depicts a cutaway view of a container in which an embodiment of the removable liner of the invention is disposed in the interior volume of a container.

Referring now to FIGS. 6, 7, 8 and 9, an embodiment of the invention that comprises a flexible sealing opening 205 disposed in a mouth portion 203 of the removable liner 001 is depicted. In this embodiment, the flexible sealing opening 205 may comprise one or more slits 215 having a first side and second side that come together in physical contact to prevent product from exiting the interior volume 210 of the removable liner 001, but, when a pressing or squeezing force is applied to the one more slit(s) 215 comprising flexible sealing opening 205, the first and second side of each split 215 are caused to separate by the application of the pressing or squeezing force to the one or more slit(s) 215, causing the one or more slit(s) 215 to open, thus allowing product to be squeezed out from the interior volume 210 of the liner bladder portion 101 (interior volume 210 of bladder portion 101 of the removable liner 001 is not called out in FIG. 9, but is called out and depicted in FIGS. 7 and 8). Removable liner 001 may comprise liner bladder portion 101 that has an outer surface 220, a mouth portion 203, a flexible sealing opening 205 disposed in the mouth portion 203, a lip 204 and an outer neck surface 202. Lip 204 and outer neck surface 202 may be sized such that they retain the removable liner 001 in a snug or press fit, or friction fit, with a receiving opening 211 in the mouth of container 102, and may be sized such that the removable liner 001 is retained in place by the snug or press fit between outer neck surface 202 and the receiving opening 211 in the container mouth, but the fit between outer neck surface 202 and the receiving opening 211 in the container mouth is not so tight that a user would be unable to pull the removable liner 001 away from the container, in the removal direction 200, disengaging the snug or press fit between outer neck surface 202 and the receiving opening 211 in the container mouth, and allowing a user to remove the removable liner 001 from the container, completely removing the removable liner 001 from the interior volume of the container 102. In embodiments, optional removable liner lip 204 may be recessed or partially recessed into a receiving recess 212 in the container mouth opening, but this recess feature is optional and need not be present. While the outer neck surface 202 and lip 204 are depicted as being round in cross sectional shape in the drawings, the embodiments depicted are exemplary only, and all other outer neck surface 202 and lip 204 cross sectional shapes, whether recessed or not recessed, are within the scope of the claimed invention. I.e. these features are depicted as being round merely as a matter of convenience for illustrative purposes. In the embodiment depicted in FIGS. 6-9, the portion for containing product, or liner bladder portion, 101 of removable liner 001 may be fabricated from portions of sheet stock that are brought together and sealed forming the liner bladder portion 101, creating a seam 201 that may be sealed by chemical bonding, heat bonding, ultrasonic bonding, or any other method for joining and sealing sheet materials this is now, or becomes, known in the art. The sheet stock may be flexible such as a flexible plastic. In the embodiment depicted in FIGS. 6-9, a user can "roll-up" the removable liner bladder portion 101 beginning with the end away from the liner mouth portion 203 (the end away from the liner mouth portion 203 being the "distal end"), and thereby create the force that causes the slits 215 to open in the flexible sealing opening 205 as product is squeezed towards and contacts the flexible sealing opening 205 under pressure resulting from the rolling up process from the distal end of the removable liner bladder portion 101. Bladder portion 101 outer surface 220 is shown for reference. In FIG. 8, product 1000 is shown for reference. Liner bladder portion 101 may be attached to neck portion 221 at 213 by any means known in the art such as molding, chemical bonding, thermal bonding, ultrasonic bonding or any other attachment means known in the art.

Figure 9:
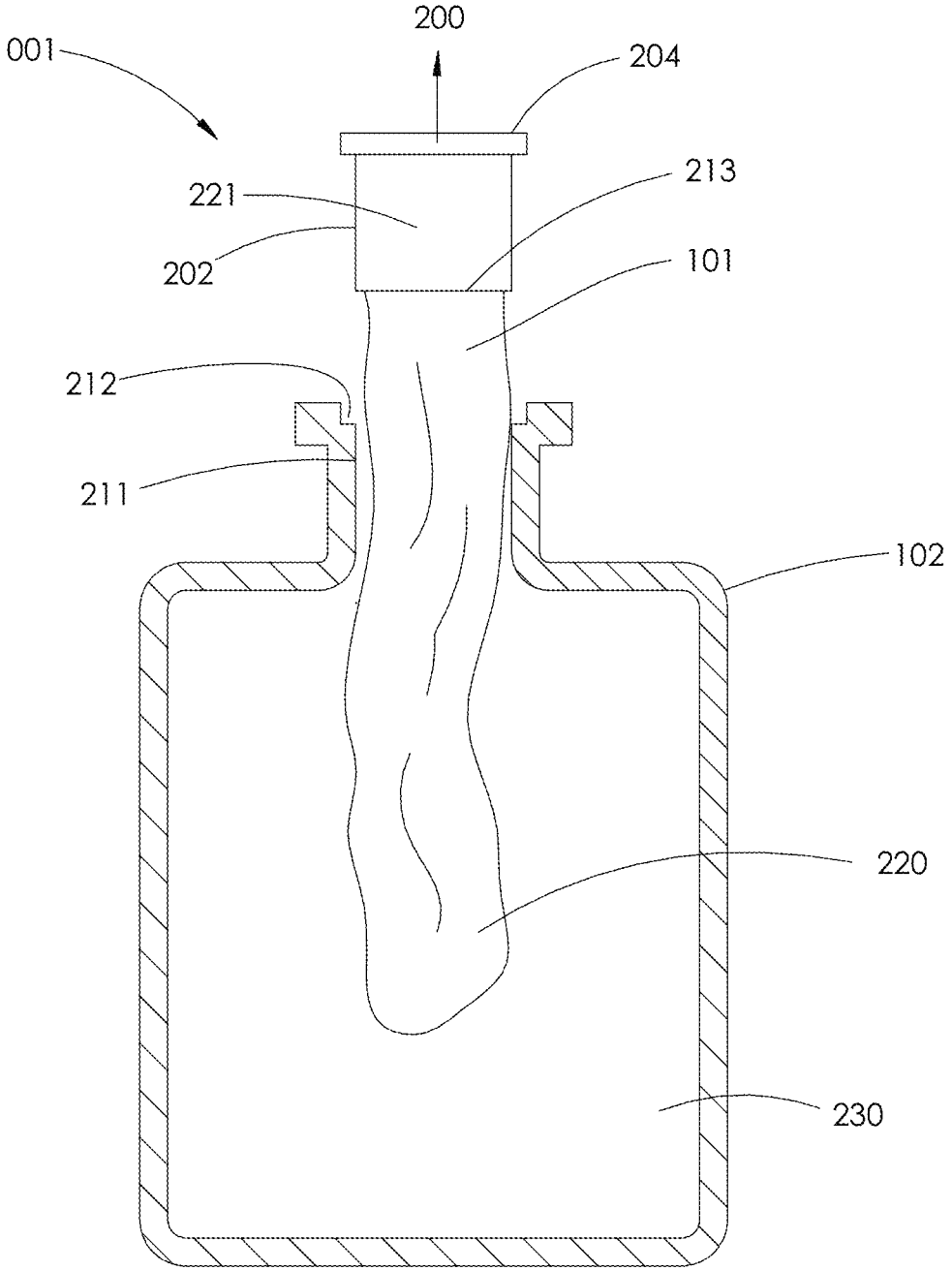
FIG. 9 depicts a cutaway view of a container, further depicting an embodiment of the removable liner of the invention in the process of being removed from the interior volume of a container.

Referring now specifically to FIG. 9, the removable liner 001 may be removed from the interior volume of the container by applying a pulling removing force in the direction arrow B to the lip 204 or any other surface of removable liner 001 such that removable liner 001 is motivated in the direction of arrow 200, i.e., away from the container. Once the removable liner 001 has been removed from the interior volume 220 of container 102, the user may apply pressure or a squeezing force to the liner bladder portion 101, causing the remaining product to be squeezed out of the interior volume 210 of liner bladder portion 101 through the mouth of the removable liner 001. (interior volume 210 of bladder portion 101 of the removable liner 001 is not called out in FIG. 9, but is called out and depicted in FIGS. 7 and 8). This pressure, or squeezing force, may be applied in any manner. For example, the user may roll up the removable liner bladder portion 101 from its distal end as hereinbefore described.

Thus, in use, the inventive removable liner 001 allows a user to access and extract remaining product that is otherwise unable to be extracted from the container 102. In some cases, substantially all of the remaining product may be removed from the interior volume of the removable liner 001, reducing waste introduced into the environment when the container 102 is discarded, thus resulting in positive environmental impact.

What is claimed is:

1. A removable liner for a container, comprising:

a liner bladder portion having an interior volume, a mouth opening, and an outer neck surface;

said container having a receiving opening with an interior surface;

wherein said removable liner is removably attached via a removable attachment to said container; and wherein said removable attachment is formed by sizing the removable liner's outer neck surface such that is adapted to form a removable snug or press fit with the interior surface of the receiving opening of said container;

wherein the removal of said removable liner from said container via said removable attachment enables a user to extract remaining product from the interior volume;

wherein said product was unable to be removed from the interior volume of the bladder portion prior to the removal of the removable liner from the container.

2. The removable liner of claim 1, said mouth opening bladder portion further comprising an openable closure, that, when in an open state, allows a user access to the interior of the removable liner, enabling removal of remaining product from the interior volume of the removable liner.

3. The removable liner of claim 2, wherein said closure is oriented in lengthwise direction relative to the exterior shape of said removable liner.

4. The removable liner of claim 2, wherein said closure is resealable.

5. The removable liner of claim 2, wherein said closure is further defined as a slider enclosure having a slider member for opening said closure.

6. The removable liner of claim 1, wherein said removable liner comprises food grade plastic material.

7. The removable liner of claim 1, wherein said removable liner is microwavable.

8. The removable liner of claim 1, wherein said liner comprises plastic material.

9. The removable liner of claim 8, wherein said plastic material is further defined as a flexible plastic material.

10. The removable liner of claim 1, wherein said removable liner comprises food grade plastic material.

11. A removable liner for a container, comprising:

a liner bladder portion having an interior volume and a mouth opening;

wherein said removable liner is removably attached via a removable attachment to said container; and wherein the removal of said removable liner from said container via said removable attachment enables a user to extract remaining product from the interior volume;

wherein said product was unable to be removed from the interior volume of the bladder portion prior to the removal of the removable liner from the container;

wherein said removable attachment comprises:

at least one liner release tab attached to said liner mouth opening, said liner release tab also forming a break-away part of said container mouth;

wherein, when said at least one liner release tab is depressed towards said container mouth opening, said at least one liner release tab breaks away from said container mouth, allowing said liner to be removed from said container through said container mouth.

12. The removable liner of claim 11, wherein said at least one liner release tab is further defined as two liner release tabs, and wherein said two liner release tabs are located so as to oppose one another on said mouth portion.

13. The removable liner of claim 11, wherein said at least one liner release tab is further defined as more than two liner release tabs.

14. The removable liner of claim 11, wherein said liner release tab break-away portion is further defined as a liner release tab area at least partially outlined by a void, or series of voids, that extend partially through a wall of the container mouth, said voids being of sufficient depth to form a weakness in the wall of the container mouth that allows said liner release tab to be broken away from said container mouth by finger pressure applied to the liner release tab in the direction of the container mouth opening.

15. The removable liner of claim 11, wherein said liner comprises plastic material.

16. The removable liner of claim 15, wherein said plastic material is further defined as a flexible plastic material.

17. The removable liner of claim 11, further comprising a closure, that, when in an open state, allows a user access to the interior of the removable liner, enabling removal of remaining product from the interior volume of the removable liner.

18. The removable liner of claim 17, wherein said openable closure is oriented in lengthwise direction relative to the exterior shape of said removable liner.

19. The removable liner of claim 17, wherein said openable closure is resealable.

20. The removable liner of claim 17, wherein said openable closure is further defined as a slider enclosure having a slider member for opening said openable closure.

21. The removable liner of claim 11, wherein said removable liner comprises food grade plastic material.

22. The removable liner of claim 11, wherein said removable liner is microwavable.

23. The removable liner of claim 11, wherein said liner release tab break-away portion is further defined as a liner release tab area at least partially outlined by a void, or series of voids, that extend partially through a wall of the container mouth, said voids being of sufficient depth to allow said liner release tab to be broken away from said container mouth by finger pressure applied to the liner release tab in the direction of the container mouth opening.

* * * * *